US008092648B2

(12) United States Patent
Nunn et al.

(10) Patent No.: US 8,092,648 B2
(45) **Date of Patent: *Jan. 10, 2012**

(54) REGENERATED COTTON BOARD MATERIAL AND METHOD OF MANUFACTURE

(76) Inventors: Kayren Joy Nunn, Bixby, OK (US); Marc Howard, Weston, FL (US); Homan B. Kinsley, Bohannon, VA (US)

( * ) Notice: Subject to any disclaimer, the term of this patent is extended or adjusted under 35 U.S.C. 154(b) by 492 days.

This patent is subject to a terminal disclaimer.

(21) Appl. No.: 12/045,610

(22) Filed: Mar. 10, 2008

(65) Prior Publication Data

US 2008/0302494 A1 Dec. 11, 2008

Related U.S. Application Data

(60) Provisional application No. 60/894,107, filed on Mar. 9, 2007.

(51) Int. Cl.
*D21F 11/00* (2006.01)

(52) U.S. Cl. ..... 162/146

(58) Field of Classification Search ..... 162/146, 162/148, 164.3, 164.6, 168.1, 169, 175
See application file for complete search history.

(56) References Cited

U.S. PATENT DOCUMENTS

| | | | | |
|---|---|---|---|---|
| 4,861,427 | A | 8/1989 | Johnson et al. | |
| 7,585,390 | B2 * | 9/2009 | Nunn et al. | 162/147 |
| 7,594,619 | B2 * | 9/2009 | Ghere et al. | 241/21 |
| 2003/0127210 | A1 | 7/2003 | Pelletier et al. | |
| 2006/0035058 | A1 | 2/2006 | Ogawa et al. | |

FOREIGN PATENT DOCUMENTS

| | | |
|---|---|---|
| WO | WO 00/58094 | 10/2005 |
| WO | PCT/US2008/056441 | 8/2008 |

OTHER PUBLICATIONS

H. W. Emerton, "The Raw Materials and Processing of Papermaking", "Handbook of Paper Science", 1980, pp. 139-163, vol. 1, Publisher: Elsevier Scientific Publishing Company, Published in: UK.

* cited by examiner

*Primary Examiner* — Mark Halpern
(74) *Attorney, Agent, or Firm* — Fellers, Snider, Blankenship, Bailey & Tippens, P.C.

(57) ABSTRACT

The present disclosure includes a regenerated cotton board material comprised of dry cut cotton lint fiber, and wood fiber. The regenerated cotton board material may further include non-cellulosic fibers such as synthetic fibers or other natural fibers. In an alternate embodiment, a cotton board material may be manufactured from a mixture of dry cut cotton lint fiber and a binder material. A method for forming a regenerated cotton board material according to the present disclosure includes forming an aqueous slurry fiber furnish from a combination of dry cut cotton lint fiber, and wood fiber. The fiber furnish is then wet processed, calendered to remove the bulk of the water, and dried.

16 Claims, No Drawings

REGENERATED COTTON BOARD MATERIAL AND METHOD OF MANUFACTURE

This application claims the benefit of U.S. Provisional Patent Application Ser. No. 60/894,107, filed on Mar. 9, 2007, the disclosure of which is incorporated herein by reference as if fully set out at this point.

FIELD OF THE INVENTION

The present invention relates to the manufacture of board material such as cardboard and paperboard, and specifically, the manufacture of such board material from regenerated components.

BACKGROUND OF THE INVENTION

Corrugated cardboard or paperboard boxes are universally used for the packaging and delivery most commercial products sold in retail and discount stores and supermarkets. These boxes are most commonly constructed of one or more layers of brown kraft paper, a strong and lightweight material that resists tearing, splitting, and bursting. This paper is made from pulped wood chips subjected to a sulfate process to form a fibrous pulp which is then processed on a conventional paper making machine. Once formed, the kraft paper may be cut and folded into paperboard boxes or may be transferred for the construction of corrugated boxes.

In the corrugating process, rolls of kraft paper are fed into a corrugator where it is crimped into a corrugating medium. Layers of uncrimped kraft paper are heated, glued, and pressed on each side of the corrugating medium most typically in an in-line process to form corrugated cardboard. A continuous sheet of corrugated cardboard is cut into wide blanks which are then cut and folded into corrugated boxes.

Due to the fact that corrugated cardboard is an inexpensive and stiff packaging material known to have a high burst strength, millions of tons are produced each year. It is estimated that more than 30 million tons of corrugated and uncorrugated cardboard are produced each year in the United States. The production of this great amount necessarily generates almost an equal amount of cardboard waste resulting from the scraps generated in manufacturing coupled with the waste generated after the useful life of the box has been exceeded. In addition, fast growing pine trees provide the primary source of the wood chips from which the wood pulp is derived. Thousands of acres of land are required to grow these pine trees. After the trees are harvested, the trunks are stripped of their limbs and shipped to the pulp mill.

The volume of natural resources necessary for cardboard and paperboard production, coupled with the waste produced as a result of that production have led to an enormous amount of cardboard and paperboard waste being sent to dumps and landfills. This enormous amount of waste has led to recycling efforts. In fact, many landfills no longer accept corrugated cardboard waste for disposal, or charge a premium (or penalty) to the waste hauler for waste which includes a high content of corrugated cardboard, due to its bulk and its ability to be recycled. Corrugated cardboard is thought to be the largest single source of recovered paper material.

Paperboard and corrugated cardboard waste is collected from recycling stations and shipped to plants where it is pulped and made into new paperboard, cardboard and other paper products. However, it has been found that paperboard, cardboard, and particularly corrugated cardboard can be recycled only a maximum number of times, approximately eight, before the pulp fibers shorten and lose strength and are no longer capable of producing a usable paper. In addition, lower quality paper is commonly used for the corrugating medium thereby limiting the ability to recycle these materials.

Even when paperboard and corrugated cardboard are recycled, however, due to the loss in fiber length and fiber strength, a problem exists in that these fibers cannot alone be recycled into new boxes. Instead the recycled pulp must be added to fresh pulp. In fact, it is known that most recycled paperboard and corrugated cardboard boxes include a maximum of only twenty percent (20%) recycled fibers. As a result, due to the demand for and continued production of paperboard and corrugated cardboard, a greater amount of such materials are produced than are capable of being recycled. A need therefore exists for a product and method of employing a greater percentage of recycled paperboard and corrugated cardboard while still maintaining the required burst strength in the regenerated product.

Historically, cotton fibers were a preferred binder in the manufacture of paper. Cotton fibers produce high quality paper; however, there is a high demand for cotton in textile manufacturing which makes it expensive for paper manufacture. As a result, refined wood pulp replaced cotton in the manufacture of paper due to its relatively inexpensive cost and abundant supply. In the advent of the manufacture of board material such as cardboard and paperboard, cotton was not considered due to its high cost. As a result, such board materials have historically been manufactured using traditional wood pulp as described above. A need, therefore, exists for a process for making a board material which utilizes the abundant supply of post-industrial and post consumer cotton scrap in a nonwoven process utilizing conventional paper making equipment.

As a result of the industrial manufacture of textile products from cotton such as apparel, carpet, furniture, and household goods, an enormous amount of scrap, clippings, imperfect (rejected) waste or scrap material is produced. It is estimated that only about half of this post-industrial (pre-consumer) scrap produced annually is recycled into usable by-products mainly for padding, stuffing, and insulating applications for the automotive, furniture, mattress, coarse yarn, home furnishings, paper, and other industries. In addition, particularly with regard to cotton apparel, and particularly denim fabrics, an enormous amount of post consumer cotton is produced annually. Such post consumer goods have historically had very little commercial value. Due to the limited demand for this material for these uses, an enormous volume of post-industrial and post consumer scrap is either burned or deposited in landfills annually. A need, therefore, exists for a board product and process of manufacture which employs fiber reclaimed from such post industrial and/or post consumer cotton scrap materials.

As a result of the industrial manufacture of other textile products such as apparel, carpet, furniture, and household goods, an enormous amount of cloth scrap, clippings, imperfect (rejected) waste or scrap material is produced. It is estimated that only about half of this post-industrial (preconsumer) scrap produced annually is recycled into usable by-products mainly for padding, stuffing, and insulating applications for the automotive, furniture, mattress, coarse yarn, home furnishings, paper, and other industries. Due to the limited demand for this material for these uses, it is estimated that in excess of 50,000 tons of post-industrial scrap is either burned or deposited in landfills annually. In light of the volume of waste produced and its heavy burden on landfills and waste streams, legislation has been enacted to require the producers of such post-industrial scrap to maintain responsibility over it, even after disposal, and be responsible for the effects caused by the disposal of such scrap. A need, therefore, exists for the development of consumer and/or industrial products which employ fibers reclaimed from such post-industrial scrap materials. In addition, a need exists for the ability to produce board products from reclaimed post-industrial fibers which can be traced back to their source of manufacture.

As a result, the bulk of reclaimed post-industrial fibers have historically been used for padding, stuffing, and insulating applications (downcycle products). A need exists for a board product which benefits from the properties provided by the presence blends of synthetic and natural fibers that can be controlled in the manufacturing process. A need also exists for a product and process which is capable of employing fibers which are nonuniform in their composition.

SUMMARY OF THE INVENTION

The present disclosure includes a board product and a method of manufacture of a board product including cotton fibers. In the process of the present disclosure, the cotton fiber may be combined with wood pulp fiber to form a unique and useful board material. In another aspect of the invention, the cotton fiber could be combined with a binder to form the board material. In yet another aspect of the invention, the cotton fiber could be combined with other natural fiber or non-cellulosic fiber such as synthetic fiber or inorganic fiber to manufacture a board product. Other additives may also be added to change the characteristics of the resultant board material.

The board product has greater burst strength both wet and dry for the same weight as presently available board materials manufactured solely from wood pulp. The resultant board product of the present disclosure could be used to make paperboard and corrugated board for use in useful items which include, but are not limited to, boxes (storage, moving, or shoe boxes for example, cartons, including slotted cartons (used to carry bottles or drinks, for example), bags (including shopping/grocery bags), coffee sleeves, and file folders. Accordingly, as used herein, the term a "board material" shall include both rigid and flexible (paper) materials.

The fibers may be virgin cotton, cellulosic, natural or synthetic fibers, however, it is desirable due to the material cost to use recycled or reclaimed fibers derived from pre and/or post consumer waste. In the event that reclaimed fibers are used, the fibers must first be opened and cut prior to use in the present process.

The board product of the present disclosure may include between 1% and 100% cotton fibers. The percentage of cotton fibers would affect the strength of the resultant board product. The fiber length is preferably between 4-6 mm and of a purity of greater than 95% cellulose.

In a particular embodiment, reclaimed cotton fibers, such as blue denim, may be mixed with recycled wood pulp, such as derived from recycled paperboard or corrugated cardboard, in the process of the present disclosure to produce a board product consisting of one hundred percent (100%) regenerated components. The resultant board product would exhibit greater wet or dry burst strength than a comparable weight paperboard or corrugated cardboard made solely from wood pulp, even solely virgin wood pulp. In addition, the percentage of recycled paperboard or corrugated cardboard could exceed twenty percent (20%).

A method of manufacture of the cotton fiber particulate of the present invention includes the general steps:

a) forming an aqueous slurry fiber furnish from a combination of i) dry cut cotton lint fiber, and;

ii) wood fiber;

b) wet processing the fiber furnish;

c) calendering the fiber furnish to remove the bulk of the water, d) drying the resulting calendered material.

In an alternate embodiment process of the present invention, the wood fiber may be replaced with a binder material.

The fiber furnish may be processed through a conventional papermaking machine to produce the board material. The fiber orientation in the fiber furnish may be random or in other embodiments may be aligned.

The process may include the additional step of combining the refined fiber furnish with a fiber furnish containing cellulosic, natural, or synthetic fibers.

The cotton fibers employed in the present process are refined via mechanical and/or chemical methods. Refining of the fibers provides for increased uniformity in fiber length. Refining also enhances the characteristic of the fibers in suppleness, absorbency, process ability, and purity.

As set forth above, the refined cotton fiber furnish may be combined with a fiber furnish containing other natural fibers. In addition, these natural fibers could be cellulosic fibers. Examples of such other cellulosic fibers include, but are not limited to, cotton linter, wood, hemp, and jute. As with the cotton fibers, these other natural and/or cellulosic fibers may require additional refining prior to being introduced to the papermaking machine.

In addition to, or in the alternative, the refined cotton fiber furnish may be combined with a fiber furnish containing synthetic fibers. Examples of such synthetic fibers include, but are not limited to polyester, nylon, acrylics, polyamides, polyolefins such as polypropylene, polyethers, and aramids.

DETAILED DESCRIPTION OF THE PREFERRED EMBODIMENT

The present invention may employ virgin cotton fibers, however, due to their abundance, it is desired to utilize cotton lint fiber from cutting table scraps. Due to the large amount of cotton used in industrial textile processing in the apparel, carpet, furniture, and household goods industries, a significant amount of post-industrial cotton is available as a waste stream, and, accordingly, is a relatively inexpensive material. Opened, cut, and refined cellulose and cotton fiber can act to strengthen or soften the substrate. Processes are available and known in the industry for cutting and opening the scrap raw material to produce component fibers. Of these types of scraps, focus was applied to denim scrap due to the abundance of this material available commercially. However, it was critical to eliminate the slow and energy intensive beating process that had been used in the past to generate pulp from pieces of such scrap materials.

In the past, old clothing was collected and processed by hand to remove buttons and other attachments. The rags were wet processed by beating the cloth into pulp. This beating was a slow (24 hour) batch process wherein the cloth was mechanically disintegrated into short fibers and fines.

Instead, in the present process, the cotton cloth scraps (denim) are dry cut into individual fibers. This generates an engineered material with a fiber length similar to that of wood pulp. This fiber material can then be combined with water to form a slurry that can be pumped with conventional wood pulp stock pumps.

Disk refiners have replaced beaters in the paper industry. In these new devices, a slurry of the fibers in water is passed between two disks that have a barred or toothed surface. In some designs, one disk rotates while the other is fixed. In other designs, the two disks are counter rotating. The fiber encounters multiple contacts with the bars or teeth. The fibers experience a high shear field in the disk refiners. The fibers swell and become hydrated similar to the fibers in a wood pulp. We observed the freeness of the refined stock was slowly reduced during the disk refining process.

While certain materials may be manufactured with the dry fiber cutting and wet processing in a paper mill. Unfortunately, when converted into paper, the denim fiber paper is weaker than commercially desired, even though cotton lint fiber is a very strong thin ribbon like fiber. When processed in the old fashion beaters for long periods of time, the resulting paper is very strong in tensile, fold, and burst, however the resulting board material manufactured from denim fibers does not generate the desired strength.

There are three attributes to paper tensile: fiber length, fiber strength, and fiber-to-fiber bonding. With excellent fiber length, such as by cutting the fiber to a length slightly longer than softwood wood pulps, and that the fiber strength of cotton being very high, means that the fiber-to-fiber bonding is the problem.

When dry cut denim is mixed with a conventional wood pulp and refined together and processed on a conventional paper making machine and tested, we were surprised to find that the mixture was stronger than the paper made from 100% denim fiber. This unexpected result led to a review of the literature on refining.

A description of the process of the refining of wood pulp is found in Chapter 3 by H. W. Emerton in *Handbook of Paper Science* Vol. 1, H. Rance editor, incorporated herein by reference. The process of refining is described as fiber shortening, internal fibrillation, external fibrillation, swelling, partial solvation of fibers, generation of fines, solvation of fines, and increased flexibility and plasticity of fibers.

The process starts with exposure of wood fibers to the high shear fields in disk refiners. Some fibers are cut to shorter lengths and all the fibers are flexed. The hydrogen bonds between the polysaccharide polymer chains are broken as the fibers are hydrated. There is an increase in the internal and external fibrillation of the fibers. Some of the surface of the fibers is detached to form fines. There is increased solvation of the fibers and fines, which leads to increased flexibility and plasticity.

When the refined pulp is formed into a sheet, the fibers conform to one another and the fines are retained. As drying occurs, the polysaccharide polymer chains are collapsed due to surface tension forces. When in molecular contact, the fibrillated fibrils reform hydrogen bonds as the water of hydration is removed by drying.

However, cotton lint fiber behaves differently than wood pulp. Cotton fiber is said to swell to only half the extent of wood pulp. This is attributed to the absence of amorphous hemicellulose in cotton and to the greater degree of irreversible internal bonding when cotton fibers first dry.

This means that the cotton fiber will hydrate less that a wood fiber. It will be stiffer and less likely to confirm to adjacent fibers in the sheet forming process. This will reduce the amount of molecular contact and thus reduce the amount of hydrogen bonding that can occur. The poorly bonded fibers will exhibit lower levels of sheet strength.

In addition, cotton fibers show little, if any, tendency to fibrillate as membranes. Because there is no lignin, and negligible quantities of non-cellulose polysaccharides, encrusting the layers of these fibers, the density of the internal hydrogen bonding that results from their initial drying out is particularly high. A proportion of this cannot be disrupted even on soaking or boiling the fibers in water. Hence the fibrillated material might be expected to have the form of bundles rather than sheets of microfibrils.

Thus cotton fibers are less likely to generate the external fibrillation and solvated fines that enhance molecular contact during drying. This important factor contributing to the development of paper strength is missing in disk refined cotton fibers. Apparently, the intense amount of refining energy used in the 24 hour beating process of the past was sufficient to generate these highly fibrillated structures.

The importance of fiber shortening to the paper making process must also be emphasized. It is essential that a portion of the wood fibers are cut across so that their length is reduced if even formation is to be achieved. Cotton fibers without shortening tend to form threads which can be caught up on parts of the machine on their approach to the wire. These then grow by entangling other fibers that are passing until they attain such a size that they break away and are swept on the wire, where they can create substantial problems.

The board material of the present disclosure processed from dry cut cotton lint fiber and refined (fibrillated, hydrated, swollen, and partially disintegrated) wood pulp is unique. A superior strength ribbon like fiber that has not been beaten to death by a 24 hour beating process that is combined with a fast beating second source of bonding material is achieved. If the cotton inter fibers are beaten enough to develop the required degree of hydrogen bonding, its fiber strength will have been damaged, thereby producing a weaker end product. In the present disclosure, wood pulp is employed as a source of hydrogen bonding material to "glue" the cotton fibers together. Because the cotton fibers are smaller in diameter a smoother and more flexible paper with superior tensile and fold strength characteristics is obtained.

The fact that the length of the cotton is controlled by a dry cutting process and not wet beating means that the best length may be chosen to achieve the desired combination of paper properties. For example the best cotton fiber length can be selected to achieve the optimum tear strength. With the same degree of pulp refining board materials with 1 mm, 2 mm, 3 mm, and 4 mm cotton fibers can be manufactured. As the length of the cotton fibers is increased, the number of hydrogen bonds per fiber will increase. Tear is a measure of the energy required to propagate the tear failure. As the fibers are pulled out of the sheet the energy is the product of the force and the distance the fibers move. If the fibers are so well bonded that they break, the force will be higher but the distance will be much less. The product of force and distance will decrease. We are thus able to optimize tear by choosing the cotton fiber length that does not result in a fiber so well refined that it breaks rather than pull out of the sheet structure.

The wood fiber can be from virtually any source of wood, including trees (ideally, salvage timber), post-industrial materials such as sawdust, wood scraps, fibers, dust, particles, shavings, wood flour, wood chips, and the like, including wood derived from used pallets, unbleached wood pulp, and post-consumer materials. However, in the preferred embodiment, wood fiber is obtained from regenerated cardboard and like materials.

The wood pulp fiber material must first be refined either with the wood fiber or before mixing with the binder in the fiber furnish. The refining process preferably includes a conventional technique for hydrating the wood pulp fiber using a disk refiner equipped with bars in a water solution, however, other refining methods are contemplated in this process.

Although hydration in a chemical sense does not occur, the affinity for water of the fiber matrix is enhanced. Refining the fiber causes the natural fibers, and particularly the cellulosic component fibers to swell (take on water, bend, and fibrillate. The swelling and fibrillation enhances the number of interfiber contacts during formation of the intermediate web. The outer surfaces of the fibers become more slippery, such that the tendency to form fiber flocs (bundles of fiber) is reduced. The refined fibers form hydrogen bonds which join them upon drying. Refining greatly increases the wet specific surface of the wood pulp fiber, the swollen specific volume, and the fiber flexibility. The result is a fiber furnish that includes fibers which are tangled and suitably prepared for further processing. Refining also significantly increases the quality of the fibers to bond with the cotton fiber when dried from the fiber furnish to form the board described herein. A freeness reduction (Canadian standard) of the natural fibers from approximately 700° CSF down to approximately 300° CSF is preferred in the present process.

The present disclosure provides the opportunity to design a board material by choosing the cotton lint fiber length and the binder. The use of a refined wood fiber as described above is preferred, or a different type of binder material can be substituted. There are many ways known to one of skill in the art to bond the cotton fibers in the sheet. Water insoluble polymers that either hydrogen bond to the cotton or develop some other type of bonding are contemplated. An example of the former would be a polyvinyl alcohol powder with a high degree of hydrolysis and high molecular weight. An example of the latter would be a powder of an olefin polymer like polyethylene or polypropylene. This powder would be sized so that it was retained in the sheet by the cotton fibers during the paper making process. After the paper was formed the polymer would be heated so that it melted and bonded the cotton fibers together.

An alternate bonding powder that functioned by a different mechanism would be an epoxy powder. Again this powder would be sized so that it was retained by the cotton fibers during sheet formation. This powder, however, would chemically react (melt and cross-link) when it got hot during the paper drying process.

A different bonding method would be the addition of a beater add latex to the furnish. As is well known in the art, the latex would be a colloid that was destabilized prior to sheet formation resulting in the deposition of the latex onto the surface of the fibers. Acrylics, vinyl alcohols, styrene butadiene, and nitrils would work to bond the surface of the cotton fibers together.

Adding a soluble resin or polymer could bond the cotton lint fiber sheet. The sheet could be saturated (either wet end or dry end) with an adhesive dissolved in solvent or water. Starch would be a good hydrogen-bonding adhesive that is very cost effective. An alternative for excellent water resistance would be a water soluble phenolic resin added as a saturant after the sheet was dried.

It is further contemplated to add dry cut man made fiber to the cotton lint fibers. After the paper was formed and dried, the sheet could be heated to fuse the synthetic polymer fibers to the cotton fibers. In the alternative, the refined cotton fiber furnish may be combined with a fiber furnish containing other natural fibers. In addition, these natural fibers could be cellulosic fibers. Examples of such other cellulosic fibers include, but are not limited to, cotton linter, wood, hemp, and jute. As with the cotton fibers, these other natural and/or cellulosic fibers may require additional refining prior to being introduced to the papermaking machine.

In addition to the wood, non-wood fibers, binding agent, fillers, and the like discussed above, other additives can be used to provide specific benefits in the end use product, hereinafter referred to collectively as "characteristic enhancers". The following optional components can be added separately or in combination in wet processing. Some components can be included into the finished product during post processing, for example, coating, impregnation, saturation, molding, and the like.

Crosslinkers can be used to provide additional strength and durability. Examples include siloxanes, phenolics, melamine formaldehyde (MF) and urea formaldehyde (UF) resins, epoxies, isocyanates, ethylene imines, and metal salts.

Retention and drainage aids can be added to control the aggregate size of the fiber/filler flocculent formed in wet end processes. They can assist in the formation of a sheet form of the regenerated board material, and also reduce the time it takes to form sheets without leaving significant residues in the water. Examples include cationic polyelectrolytes, cationic latex, cationic starch, metal salts and metal ions such as alum and the like, other cationic materials such as epicholorohydrin-amine adducts, e.g., Kymene® products from Hercules, and polyethylene imines.

Hydrophobic Agents can improve the water repellency and reduce the water absorbency characteristics of the material, either by changing the surface energy, or by filling voids in the regenerated material. Representative examples include wax, silicones, fluorinated materials, hydrocarbon additives, oils, fats, fatty acids, calcium stearate, and glycols such as polyethylene glycol.

Coloring Agents provide coloring to the board material. These include organic and inorganic pigments and dyes, examples of which include phthalocynanine blue, iron oxide, titanium oxide, carbon black, indigo, and the like. In some embodiments, the color of the material is provided, at least in part, by the type of wood that is used.

Dispersants/Surfactants can be added to keep the fillers and pigments wetted and well dispersed in the formulation. In wet end processing, they can also help control the formation of the material. Examples include carboxylate, ethoxylate and sulfonate-based materials, e.g., Tamol® L, Tamol® 731A, Morcryl® (all from Rohm and Haas).

Chelating Agents are used to chelate the metal ions in the wet end process. They also help to control the aggregate size and thereby can affect drainage and retention. Examples include EDTA and EDTA derivatives.

A coagulant/flocculant can also be added to the fiber furnish to facilitate flocculation of the particles. Suitable cationic coagulants include polyacrylamides, including those with low, medium, and high molecular weight, and low, medium, and high cationic charge, alum and/or other polymer high charge coagulants, for example, polyamines (cationic polymers), and mineral salt divalent and trivalent ions, examples of which include calcium and aluminum salts, respectively. Suitable flocculants include low, medium, or high molecular weight polyacrylamides with low, medium, or high cationic charge. To further improve the drainage of the fiber furnish, drainage aids such as colloidal silica, bentonite, or other high surface area particles may be employed. An example of a preferred flocculant package may include a polyamine such as Alcofix 159 or Nalcat 7609 or Bubond 167, with a low charge polyacrylamide such as Superthol MX40, Bufloc 594, or Nalco 61067, and colloidal silica such as Bufloc 5461 or Eka NP780.

The above described board material may be manufactured by a process that includes the following general steps:

a) forming an aqueous slurry fiber furnish from a combination of i) dry cut cotton lint fiber, and;

ii) wood fiber;

b) wet processing the fiber furnish;

b) calendering the fiber furnish to remove the bulk of the water, c) drying the resulting calendered material.

In an alternate embodiment process of the present invention, the wood fiber may be replaced with a binder material. The fiber furnish may be processed through a conventional papermaking machine to produce the board material.

In the specification, typical embodiments have been disclosed and, although specific terms are employed, they are used in a generic and descriptive sense and not for purposes of limitation. It should be clearly understood that resort can be had to various other embodiments, aspects, modifications, and equivalents to those disclosed in the claims, which, after reading the description herein, may suggest themselves to one of ordinary skill in the art without departing from the spirit of the present disclosure or the scope of these claims. The following claims are provided to ensure that the present application meets all statutory requirements as a priority application in all jurisdictions and shall not be construed as setting forth the full scope of the latex composition, methods for use of same, and articles incorporating or containing same that are disclosed herein.

The invention claimed is:

1. A method for forming a regenerated cotton board material, comprising:

a) forming an aqueous slurry fiber furnish from a combination of i) dry cut cotton lint fiber, and;

ii) refined wood fiber;

b) wet processing the fiber furnish;

c) calendering the fiber furnish to remove the bulk of the water, d) drying the resulting calendered material.

2. The process of claim 1 wherein non-cellulosic fiber selected from the group consisting of natural fibers, synthetic polymer fibers, and inorganic fibers are added to the fiber furnish.

3. The process of claim 1 wherein characteristic enhancers are added to the slurry.

4. The process of claim 1 wherein a binder is added to the slurry.

5. The method of claim 4 wherein the binder is a latex.

6. The method of claim 4 wherein said binder is polyethylene or polypropylene.

7. The method of claim 4 wherein said binder is a polyamide.

8. The method of claim 4 wherein said binder is a polyester.

9. The method of claim 4 wherein said binder is an epoxy.

10. The method of claim 4 wherein said binder is a styrene butadiene.

11. The process of claim 1 wherein the wood fiber is disk refined to about 300° Canadian Standard Freeness (CSF) and then mixed with the cotton lint fiber in the slurry.

12. The method of claim 1 wherein the binder material is a polymer particle whose largest dimension is greater than 15 micrometers.

13. The method of claim 1 wherein the wood fiber is softwood kraft or sulfite pulp.

14. The method of claim 1 wherein the wood fiber is hardwood kraft or sulfite pulp.

15. A method for forming a regenerated cotton board material, comprising:

a) forming an aqueous slurry fiber furnish from a combination of i) dry cut cotton lint fiber derived from cotton scrap, and;

ii) a binder;

b) wet processing the fiber furnish;

c) calendering the fiber furnish to remove the bulk of the water, d) drying the resulting calendered material.

16. The process of claim 15 wherein non-cellulosic fiber selected from the group consisting of natural fibers, synthetic polymer fibers, and inorganic fibers are added to the fiber furnish.

* * * * *